US006179436B1

(12) United States Patent
Gitkind

(10) Patent No.: US 6,179,436 B1
(45) Date of Patent: Jan. 30, 2001

(54) BACKPACK LANTERN

(76) Inventor: Neil Gitkind, 1620-16th Ave., Apt. #1, Seattle, WA (US) 98122

( * ) Notice: Under 35 U.S.C. 154(b), the term of this patent shall be extended for 0 days.

(21) Appl. No.: 09/153,777

(22) Filed: Sep. 15, 1998

(51) Int. Cl.[7] ..... F21W 131/00; F21V 3/00
(52) U.S. Cl. ..... 362/154; 362/101; 362/190
(58) Field of Search ..... 362/96, 101, 154, 362/311, 190, 191, 374

(56) References Cited

U.S. PATENT DOCUMENTS

| | | | | |
|---|---|---|---|---|
| 4,004,132 | | 1/1977 | Glass et al. | 240/10.63 |
| 4,225,907 | | 9/1980 | Erdell | 362/255 |
| 4,231,077 | | 10/1980 | Joyce et al. | 362/32 |
| 4,257,085 | | 3/1981 | Kimmel | 362/186 |
| 4,369,487 | | 1/1983 | Carlow | 362/258 |
| 4,388,674 | | 6/1983 | Sano | 362/186 |
| 4,428,034 | | 1/1984 | Seller | 362/186 |
| 4,502,102 | | 2/1985 | Phipps | 362/183 |
| 4,697,228 | | 9/1987 | Mui et al. | 362/352 |
| 4,714,985 | * | 12/1987 | Hickey | 362/154 |
| 4,739,457 | | 4/1988 | Orr | 362/287 |
| 4,740,874 | | 4/1988 | Wylie et al. | 362/268 |
| 4,782,433 | | 11/1988 | Rombough | 362/186 |
| 4,914,748 | | 4/1990 | Schlotter, IV et al. | 362/109 |
| 5,001,612 | | 3/1991 | Odlum | 362/187 |
| 5,178,450 | * | 1/1993 | Zelensky | 362/101 X |
| 5,190,369 | | 3/1993 | Pace | 362/186 |
| 5,383,103 | | 1/1995 | Pasch et al. | 362/102 |
| 5,412,548 | | 5/1995 | Yee | 362/202 |

OTHER PUBLICATIONS

Backpacker Magazine; "Packlite Lantern Kit"; J. Dom; p. 127, Aug. 1998.*

* cited by examiner

*Primary Examiner*—Laura K. Tso
(74) *Attorney, Agent, or Firm*—Patrick M. Dwyer

(57) ABSTRACT

A light source attachment intended for use as a lantern for camping or for use in the home. The light source attachment may function also as a container for drinking water or other fluids or solids or for the measurement of volume of fluids or solids for use in cooking. A light source is positioned in order to direct a beam of light through a non-opaque lid and into a non-opaque container. The container may be modified with reflectors at its bottom or around its sides. The light beam encounters the side and bottom of the container and naturally illuminates all of its surfaces. The container thereby emanates a glow and thereby provides general illumination. The container may be filled with water during its use.

12 Claims, 13 Drawing Sheets

BACKPACK LANTERN

TECHNICAL FIELD

The invention relates to lighting implements; more particularly, it relates to a method and apparatus for a type of lantern, particularly adapted to backpacking and other pursuits requiring portable and/or modular lighting equipment.

BACKGROUND OF THE INVENTION

Lanterns for use in backpacking are generally single purpose relatively bulky items, that in addition are of little use in projecting a flashlight-like beam. Since a backpacker will usually use some kind of flashlight, conversions have been proposed. Flashlight attachments which are tubular are known in the art. One such device employs a light tunnel having a reflective surface at its end while another has an open ended tube. Some devices are intended to be used as light wands while others simply redirect the light beam. Many other lantern devices exist for use in the absence of wall power for camping and other purposes. Most are of relatively high cost and are harsh when viewed directly because one is looking directly at the light source such as a filament in a bulb. What is needed is a conversion accessory for attachment to an existing light source, where the accessory preferably has an independent use, and is largely independent of the light source shape. Such a device would be practical for those in need of a compact and lightweight lantern for backpacking, or for those who wish to easily convert an existing light source into a lantern.

DISCLOSURE OF THE INVENTION

Accordingly it is the object of the invention to provide a device for converting a standard flashlight or head lamp or light emitting diode (LED) light source into a lantern for general area illumination using a standard backpacker's container.

It is a further object of the invention that the lantern be large in illumination area, for use in beaconing, without taking extra packing space.

It is a further object of the invention that commercially available light sources can be accommodated without any modification whatsoever.

It is a further object of the invention that the device function fully as a lantern when the container is partially full or completely full of water, or any other clear liquid.

It is a further object of the invention to use a container that doubles as a fluid or solid container.

It is further an object of the invention to provide a new use for a container already possessed by the user.

It is a further object of the invention that the container provide a measurement capability for use in cooking.

It is a further object of the invention to provide lightweight and compact means for attachment of the light source to the container.

It is a further object of the invention to provide a soft-light lantern.

These and such other objects of the invention as will become evident from the disclosure below are met by the invention disclosed herein.

The invention addresses and provides such a system. The invention represents a multi-use, lightweight, soft-light, light source attachment and/or kit for making a backpacking lantern.

Application of the invention to a backpacker's need for a large area lantern which takes up negligible additional space is especially beneficial in that the invention is the only system that effectively provides solutions to these needs.

It is a further object to utilize a container which is already in general use, and therefore of known and existing utility to backpackers. The preferred embodiment utilizes such a container but is not limited to the use of such containers.

In one aspect the invention is lantern that is composed of a closeable translucent container, a light source and a coupler for releasably connecting the container to the light source. The lantern preferably also has at least one first releasable connector and a second releasable connector attachable to the container for releasable connection to the first connector. The lantern also preferably has a container lid closed upon the container, and the second connector is optionally attachable to the lid. Some embodiments of the lantern alternately have an elastomeric coupler having a central portion and an outer portion, the center portion having a hole, and the outer portion further comprising at least one first releasable connector, and a second releasable connector attachable to the container for releasable connection to the first connector. The second connector advantageously has a plurality of attachment rings on the perimeter of the connector, and may also have a dish-shaped part engageable with a bottom of the container. In some embodiments the first connector has a hole in its center, and the outer portion of the first connector has a plurality of legs. A lid for use in the invention is preferably translucent. The lantern of the invention may also employ a reflector on a bottom of the container, and a reflector which at least partially covers a wall of the container.

The lantern of the invention employs a light source selected from the group consisting of a standard flashlight, a standard headlamp, a stand alone LED flashlight and an LED integrated into the lid of the container, or like light-sources whether now known or later developed. The lantern may also have a light redirecting film interposed between the light source and the container interior. The light redirecting film optimally has a thickness greater than zero and less than 5 millimeters and is preferably made of a transparent material having a variable thickness. In some cases the container lid itself may be the light redirecting film.

Another aspect of the invention is a lantern kit having a coupler adapted to releasably connect a translucent container to a light source. In some embodiments, the coupler is a container lid closeable on the container, the lid having a plurality of gripping projections, the projections adapted to releasably attach to a light source having an output reflector smaller than the diameter of the lid. Alternatively, the coupler has a preferably elastic member having at least one first releasable connector and a second releasable connector attachable to a container for releasable connection to the first connector. Alternatively, the coupler has a band of resilient material having attached on at least a portion of its outer circumference some hook and loop material, the band lockable onto the lid. Alternatively, the coupler is a lid containing a light source and a power source. The light source may advantageously be an integral plurality of light emitting diodes, the light emitting diodes disposed to direct their light into the interior of the container, and a driving circuit to provide electrical stimulus to the LED devices, along with battery mounts for the power source.

Another aspect of the invention is a bag for enclosing a container and at least a portion of a lightsource, where the container has a lid and the bag has a releasable cinching closure at an open end, whereby the closure engages the enclosed portion of the lightsource to at least in part urge the lightsource against the lid. The bag may optionally have a plurality of compression straps, at least one of which is attached to the bag at a point below the cinching closure when it is closed and above the lid of the container.

Some embodiments of the invention employ a permanent container modification and/or a permanent lid modification as part of the light source attachment accessory. Other embodiments employ unmodified or conventional containers and/or lids that are then reversibly modified in accordance with the invention in order to effect the attachment accessory. In either case parts may be provided to the user as part of the practice of the invention in a kit to enable the user to make the permanent or reversible modification of the container and/or lid. Preferred embodiments require the use of a container and a lid which are at least translucent.

The light source accessory of the present invention employs a hollow, sealable container; it also preferably has means for attachment of light sources having various shape and size to the container. A preferred attachment means is a coupler which captures the light source and anchors it to the container.

The coupler is desirably elastomeric and utilizes its own restorative force to anchor the light source to the container. The elastomeric coupler may be formed from a single material or a combination of materials, and desirably has a central portion and at least one outer portion, the outer portion having the ability to stretch away from the inner portion, the center portion preferably having a hole in the middle but leaving enough material to connect the outer portions to each other. In this case the outer portions of the coupler are stretched and then releasably attached to a corresponding feature attached to the container. This attachment may be accomplished by way of Velcro® type closures for instance. Alternately the coupler may be of a non-stretchable material in combination with non-stretchable straps which cinch for tightening. In that case buckle features are mounted on the bottle for the straps to thread through.

In the case of a flashlight type light source having an elongated barrel and an expanded diameter portion which is disposed at one end of the barrel, the coupler (sometimes referred to herein as an upper coupler) captures the light source with material surrounding a central hole, the hole having a diameter smaller than the barrel diameter in the case of the flexible coupler, and of the same approximate diameter for a non-stretchable coupler. The coupler material surrounding the hole provides an attachment shoulder to urge the expanded diameter portion of the flashlight toward and against the container.

Alternatively a multi-use, or universal, coupler is provided. It has flaps or arms extending radially from the center, the flaps having different sized holes at the ends for different diameter flashlight barrels. In use, one of the flaps is folded toward the center of the coupler such that the smaller hole can be used with flashlights having a diameter smaller than that appropriate to the central hole. This same coupler is used to strap over the top of headlamp-type light sources. This approach provides a multiuse coupler thereby reducing expense and obviating the need to switch couplers for different light source types.

A special headlamp strap may optionally be provided so that for a headlamp the coupler need not have a hole, but may consist of continuous material which constrains the headlamp (or any similarly shaped lighting device) by looping over the top of the headlamp and lashing it to the lid surface.

The coupler, or upper coupler, can also connect to the container by looping all the way around the bottom of the container, preferably by means of a bottom coupler. A bottom coupler for such a flashlight upper coupler preferably provides a disk-like flat surface disposed against the bottom of the container as well as a binding region for connection to the upper coupler. The bottom of the container acts as a mechanical stop against which the bottom coupler is disposed. The upper coupler is of a design similar to that described above, and may be either stretchable or non-stretchable. The upper coupler is disposed against the light source as described above. The bottom disk of the bottom coupler may be either rigid or flexible. The side facing the container may have a reflective surface to increase the illumination level of the lantern. The bottom disk may alternatively serve as a lightshield for use in a walking lantern.

Alternately, a lower coupler may anchor to the container around the throat of the container, the throat being the section of the container between the lid and the shoulder of the container. The lid, the container threads, or a separate ridge provides the mechanical stop against which a coupler ring is disposed and then attached to an upper coupler similar to the ones described above.

The light sources that the invention will accommodate include but are not limited to, traditional D-cell, C-cell or AA-cell flashlights; headlamps used commonly for camping; and light emitting diode (LED) based flashlights or other portable lighting technologies that are not yet commercially available.

Alternately, the lid of a container may have integrated features, either detachable or permanent, which provide the coupling function. Such an integrated lid could be provided separately to the user to decrease its expense. For a flashlight type light source, the expanded diameter portion of the barrel could slide into, and be held by friction or some other releasable connection by, a coaxial feature of the lid. The lid feature could be integrally molded with the lid or attached as a separate part. The lid feature could contain a plurality of coaxial features which attach to a range of light source diameters.

Alternatively, a detachable lid device consists of a cylindrically shaped part having a diameter slightly larger than the lid and containing molded-in locking features is slid down around the lid causing the locking features to expand slightly and then engage the lower outer edge of the lid to thereafter resist any upward force. This part has hook and loop material attached to its outer circumference to provide attachment means when using the stretchable coupler described above.

Another lid attachment device locks onto the lid by way of a over-center type clamping device which results in a circumferentially applied, radially inward directed force. This part also advantageously has hook and loop material attached to its outer circumference to provide attachment means when using the stretchable coupler described above.

Alternatively the otherwise conventional lid has loop material affixed around its outer vertical wall. In this manner the lid becomes the anchoring region for the attachment couplers described above.

The embodiments described above which involve either permanent or integrated modifications to the lid alone may be provided to the user separately for use with already owned containers that are compatible to the lid.

An alternate embodiment provides a use for a container which is already owned by the user that requires no modification to the container. In addition different sizes and shapes of container bottles are contemplated for use. In this embodiment a soft holder or bag contains the translucent container and lid. The bag is constructed from a mesh or otherwise light transmitting material so that a minimal amount of light is blocked by the bag. Previously described attachment features are integrated into the bag so that a single part performs the function of releasable attachment of a many types of light sources to the container. The bag is taller than the container and lid, and it is closed at its bottom and open at its top. The top of the bag is open to allow insertion of the container and to allow the cylindrical part of a flashlight to extend beyond the bag's height. The open end of the bag has closing or cinching means such as a draw string which enables a cinching around the flashlight barrel above or near the wider lens end of the flashlight, thereby providing a surface or shoulder against which the drawn closed portion of the bag opening urges against the flared section of the flashlight. In use with a headlamp however, the top of the bag does close to provide a surface with which to pull down on the headlamp. In preferred embodiments, the bag has integral compression means to provide a downward force on the lightsource, counterbalanced by the corresponding upward force at the bottom of the bag.

In the case of an LED based light source, a very compact lantern could be made by integration of the LED devices themselves into the lid of a container. Such an integrated lid could be provided separately to the user to decrease its expense. The LED's could be co-molded with the lid or attached to an existing lid. The lid would further integrate the light source function by accommodating a power supply and LED driving circuit. A filament type light bulb could be similarly integrated into the lid.

A light redirecting film placed between the light source and the container interior, or light redirecting features integrated into the container lid itself, can be used to increase the illumination of the lantern by causing some additional light rays from the light source to impinge directly on the wall of the container. This improvement is applicable to all embodiments of the invention.

BEST MODE OF CARRYING OUT THE INVENTION

Figure 1:
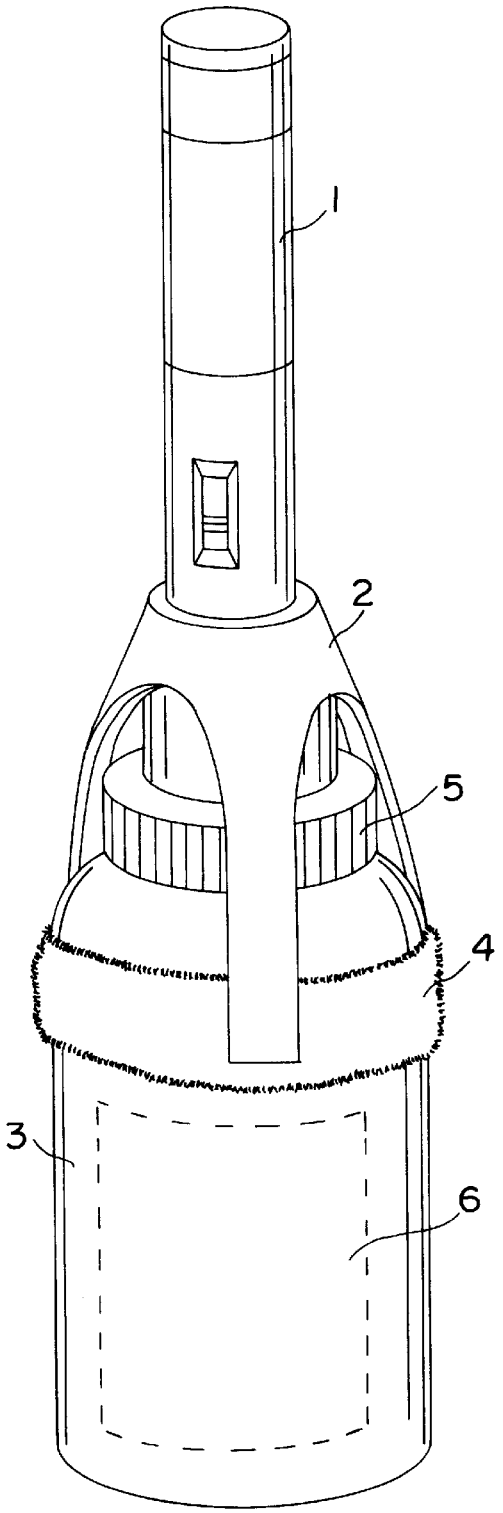
FIG. 1 Illustrates a perspective view of an embodiment of the invention shown with a typical D-cell flashlight.

FIG. 1 shows an embodiment of the invention using an elastomeric coupler 2 with a typical D-cell flashlight. The flashlight 1 is captured by the elastomeric coupler 2 and releasably anchored to the container 3 by way of hook fabric and loop fabric fastening. In the case shown in FIG. 1, a closed ring of loop fabric 4 is glued or welded or bound in some other way to the container near its top. When the flashlight is on, the light beam enters the container 3 through the lid 5. The light is diffused by the lid and strikes all of the interior surfaces of the container causing a glow to be emanated from the bottle. Reflector 6 may be employed advantageously to focus or intensify light emanation to specific regions of the bottle.

Figure 2A:
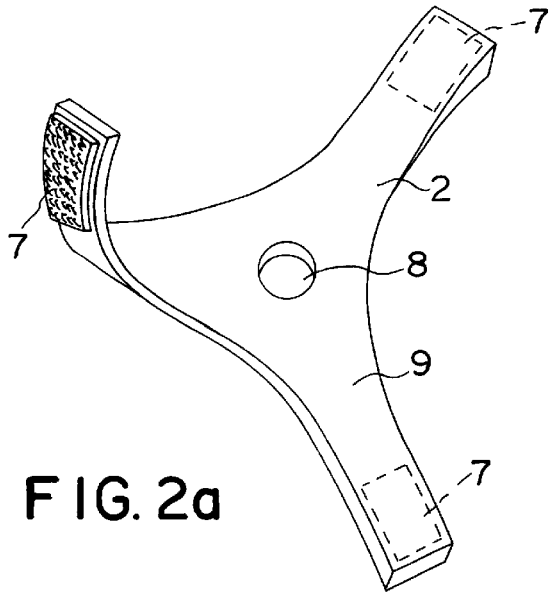
FIGS. 2*a, b* and *c* are three versions of light source couplers for the invention.
Figure 2B:
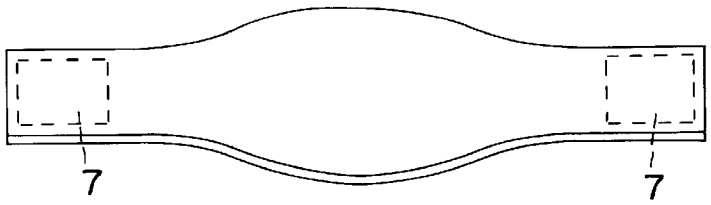
Figure 2C:
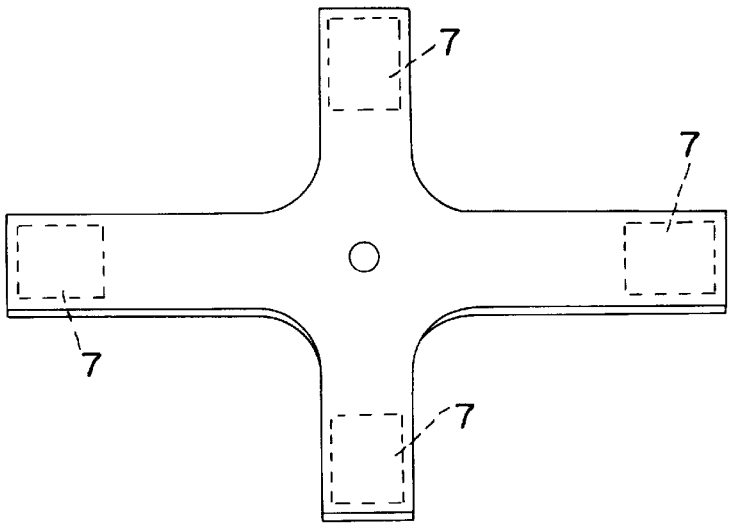

FIG. 2 shows three elastomeric coupler designs which have two, three or four legs. These are examples and in practice designs having more legs or no legs at all are feasible. Hook or loop fabric 7 is fastened to the areas indicated in the figures. In use, these fabric patches are pulled by hand toward the complementary fabric 4 on the container 3 for anchoring of the light source 1. In the case of a light source having an elongated barrel and an expanded diameter portion which is disposed at one end of the barrel, (such as the flashlights in FIGS. 1 and 3*b*) the barrel protrudes through a hole 8 in the coupler 2.

In a preferred embodiment of the elastomeric coupler, the elastomer material has fabric laminated to one side 9, and the hook or loop fabric is located on the side of its natural surface. The fabric surface enables sewing and aesthetic appeal. The natural surface enhances the friction which facilitates the capture function of the coupler.

Figure 13:
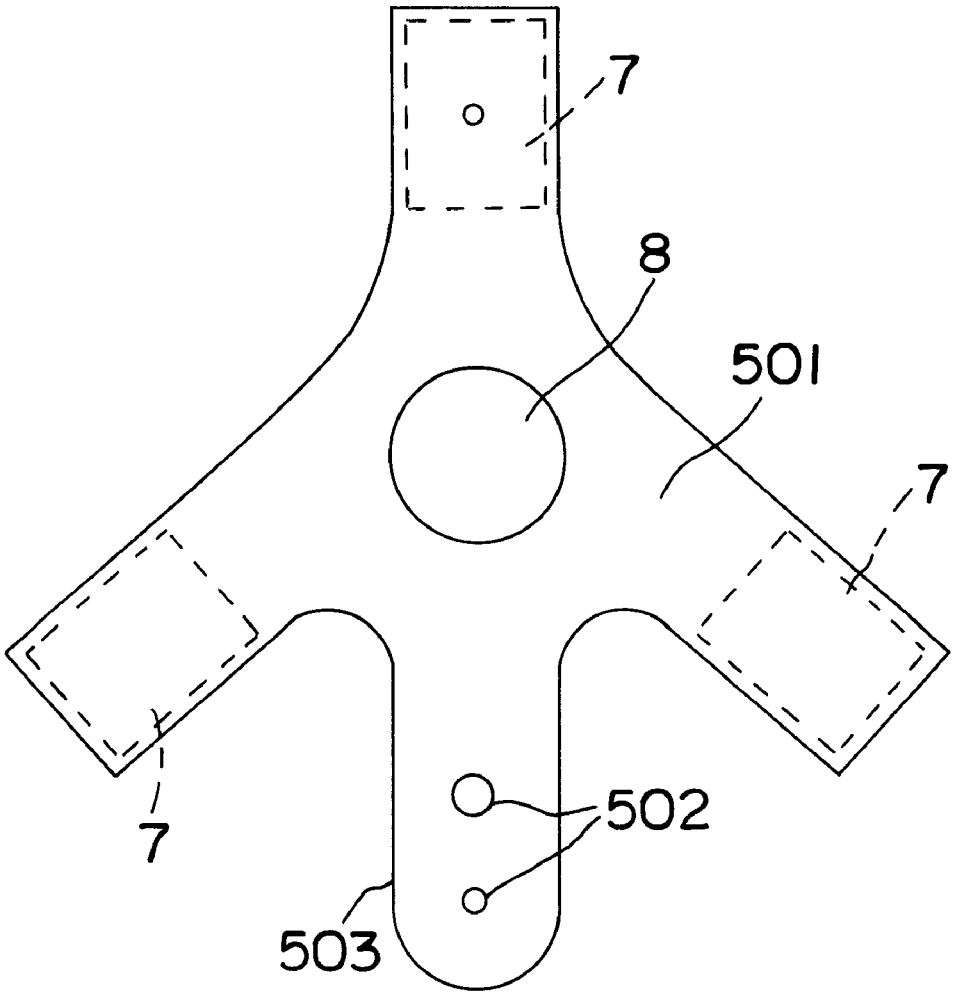
FIG. 13 is a version of the coupler having universal function.

FIG. 13 shows an additional embodiment of the elastomeric coupler 501, where one of the flaps or legs 503 of the coupler has one or more holes 502, which are smaller than the center hole 8, through which the flashlight barrel protrudes. The additional holes allow the use of smaller flashlights which have smaller barrel diameters. In use the leg 503 is folded under so that the appropriate smaller hole is concentric with the center hole 8. The flashlight is then inserted upward first through the smaller hole and then through center hole 8, and then the other legs are pulled down to the connecting material.

Figure 3A:
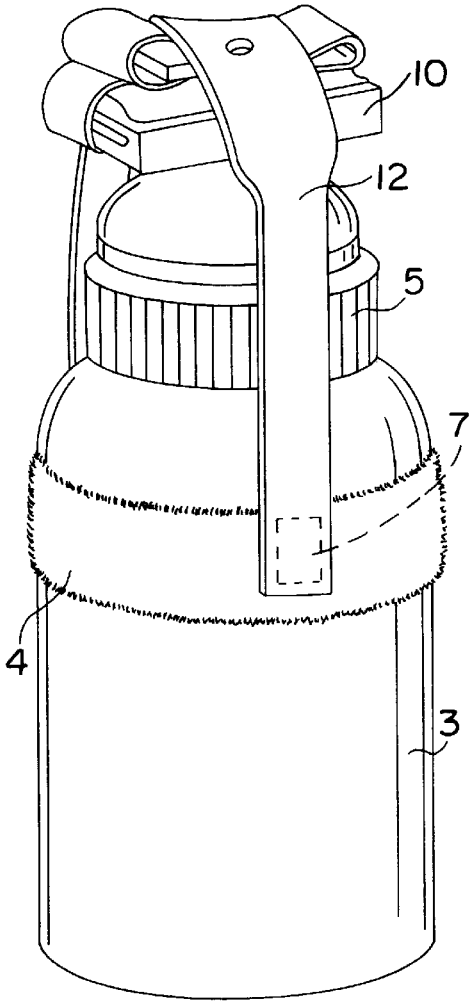
FIG. 3*a* is an alternate embodiment of the invention shown with a typical headlamp.
Figure 3B:
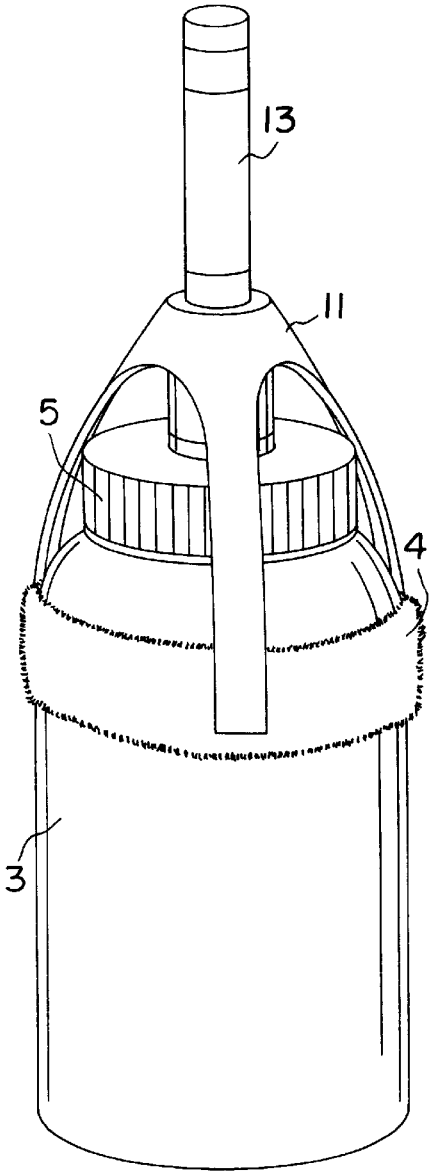
FIG. 3*b* is an alternate embodiment of the invention shown with a typical AA-cell flashlight.

FIG. 3 shows two additional embodiments of the invention which use an elastomeric coupler. FIG. 3*a* shows the invention in use with a typical headlamp 10, which are commonly available for hiking and camping. Similar to FIG. 1, the light source 10 is captured and anchored by an elastomeric coupler 12. The coupler is anchored to the container 3 by the hook and loop connection. FIG. 3*b* shows a miniature flashlight 13 attached using a coupler 11 which is similar to the coupler 2 in FIG. 1.

Figure 12:
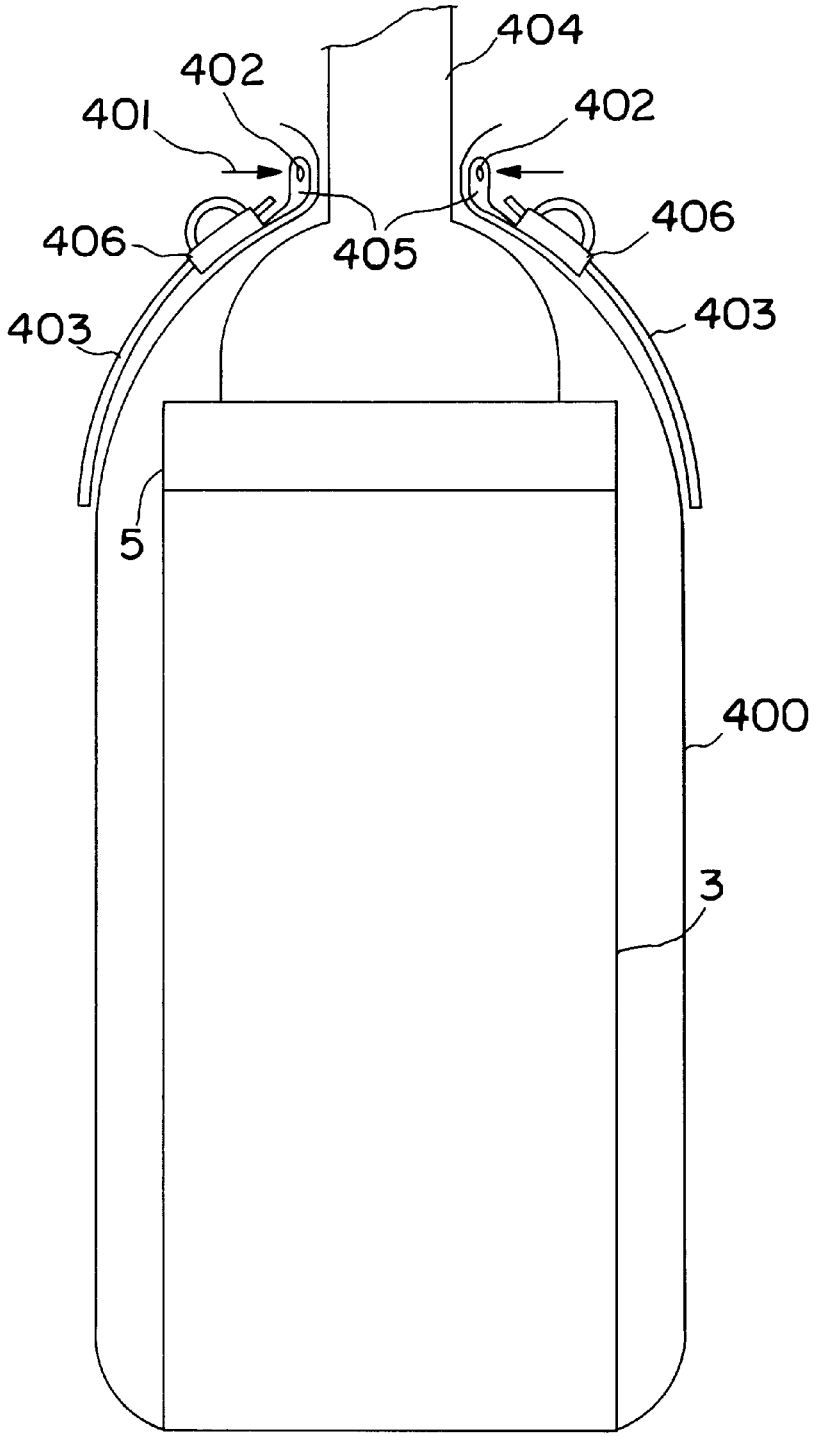
FIG. 12 is a partial sectional elevation of an alternative embodiment of the invention where a bag provides attachment means.

FIGS. 4, and 5 and 12 show embodiments of the invention using alternatives to the elastomeric coupler designs.

Figure 4B:
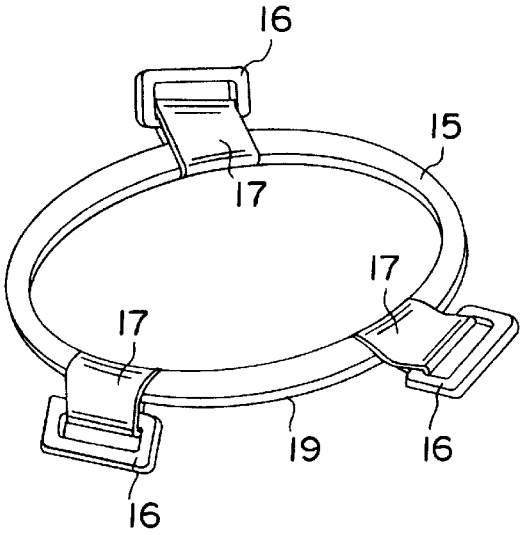
FIGS. 4*a, b* is an alternative embodiment in which the light source is anchored to the container by way of buckles positioned around the throat of the container.
Figure 4A:
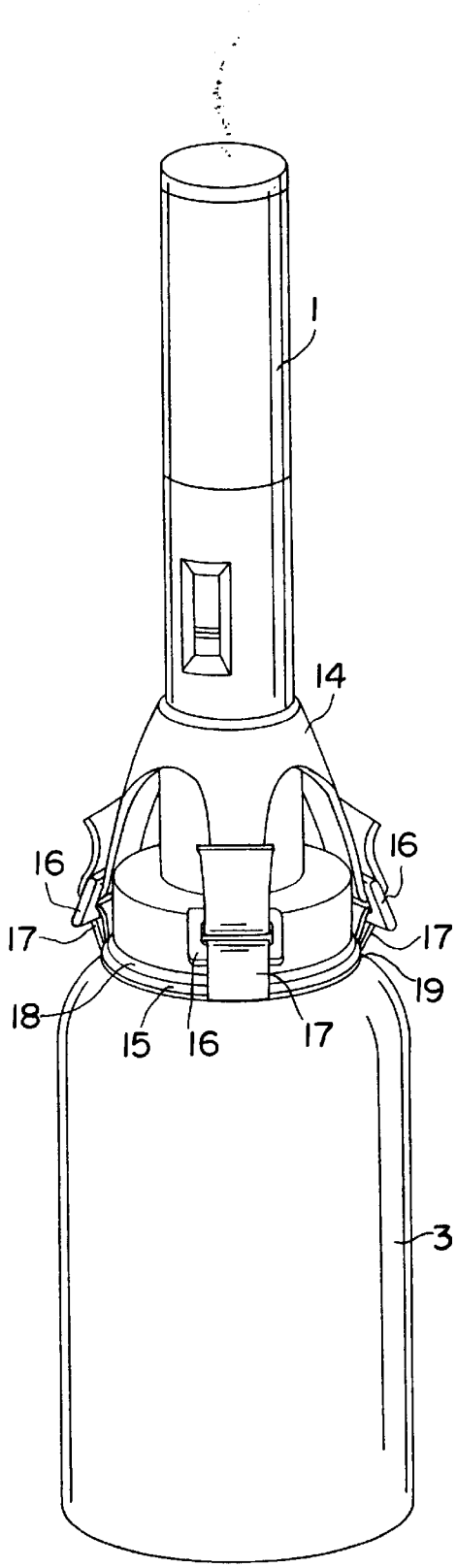

FIG. 4*a*, shows two coupler parts 14, 19 which attach to the throat of the container 3. The upper coupler part 14 is of the same general design as the coupler described above. The light source 1 is captured in the same ways described above. The light source 1 is anchored and tightened to the container 3 by manually pulling the outer portion of the coupler 14 through the buckles 16. The lower coupler 19 is further comprised of a ring 15 and a plurality of straps 17 which connects an equal number of buckles 16 to the ring 15 as shown in FIG. 4*b*. In use, the outer portion of the coupler 14 is threaded through the buckles 16. The lower coupler 19 is captured between the shoulder of the container 3 and a circumferential ridge 18 feature below the container threads. Again the coupler 14 is shown holding a barrel type flashlight, however this embodiment will work with any of the generalized coupler designs described above.

Figure 5A:
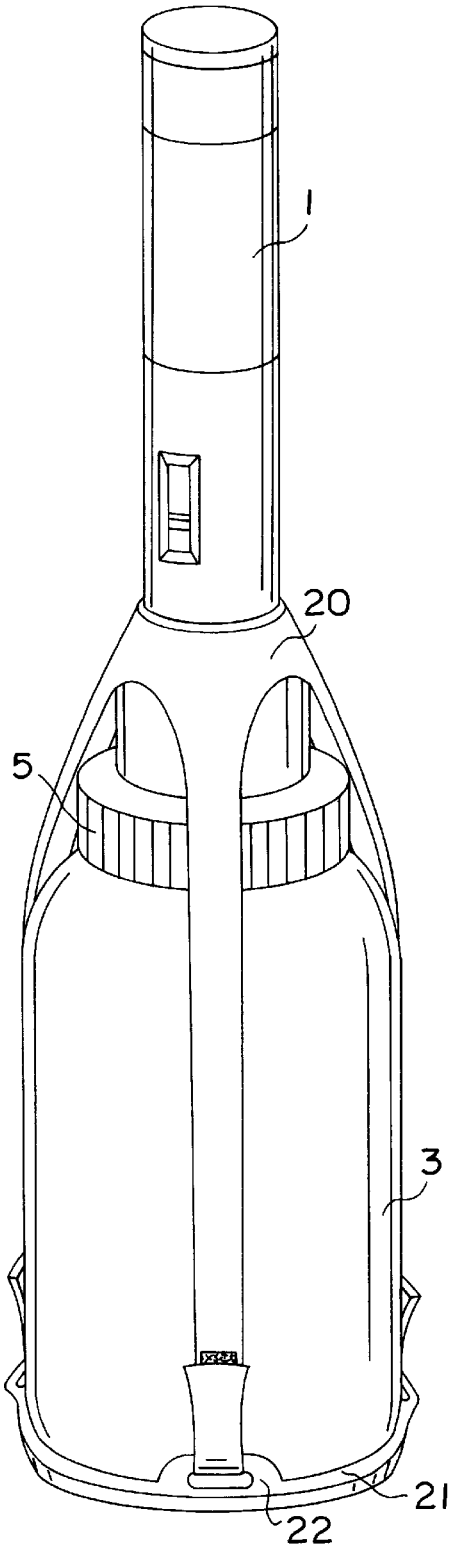
FIGS. 5*a, b* is another alternative embodiment in which the light source is anchored to the container by a coupler which goes all the way around the bottom of the container.
Figure 5B:
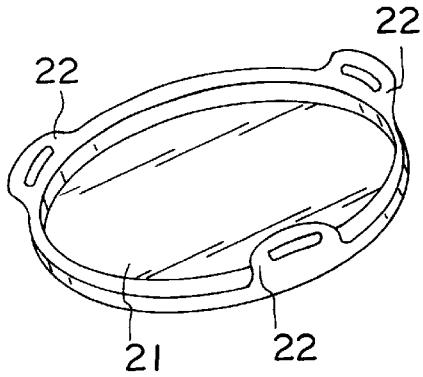

FIG. 5*a* shows two coupler parts 20, 21 which together attach around the bottom of the container 3. The upper coupler part 20 is of the same general design as the coupler described above except that it has longer outer features which extend to the bottom of the container. The light source 1 is captured in the same ways described above. The light source 1 is anchored and tightened to the container 3 by manually pulling the outer portion of the coupler 20 through the holes 22. FIG. 5*b* shows the lower coupler 21, a disk having holes 22 through which the outer portion of the upper coupler 20 threads. Again the coupler 20 is shown holding a barrel type flashlight, however this embodiment will work with any of the generalized coupler designs described above.

FIG. 12 shows an embodiment of the invention where soft holder or bag 400 is used to attach the lightsource 404 to the container. A headlamp can substitute for flashlight 404 as will be described below. The bag is preferably constructed from a mesh or from an otherwise light transmitting material, so that a minimal amount of light is blocked. The bag is closed at its bottom and it is adjustably open at its top. The translucent container 3 and transparent or translucent lid 5 are inserted into the bag 400 so that the closed end of the bag coincides with the bottom of the container 3. The bag is taller than the container 3 and lid 5. The top of the bag allows the cylindrical part of the flashlight 404 to extend beyond the bag's height. The open end of the bag 400 has closing strings 402 which enables a cinching around the flashlight barrel in the direction of arrows 401, thereby providing a surface with which to pull down on the flared section of the flashlight. In use with a headlamp, the top of the bag cinches substantially closed in order to provide a surface with which to pull down on the headlamp. The bag has integral compression means 403, 405, 406 which enable the application of a downward force on the lightsource, causing an upward force at the bottom of the bag. In the figure upper straps 405 are preferably permanently connected to a buckle 406. The preferred compression straps 403 are tightened by manually pulling the lower strap 403 through the buckle 406.

Figure 6A:
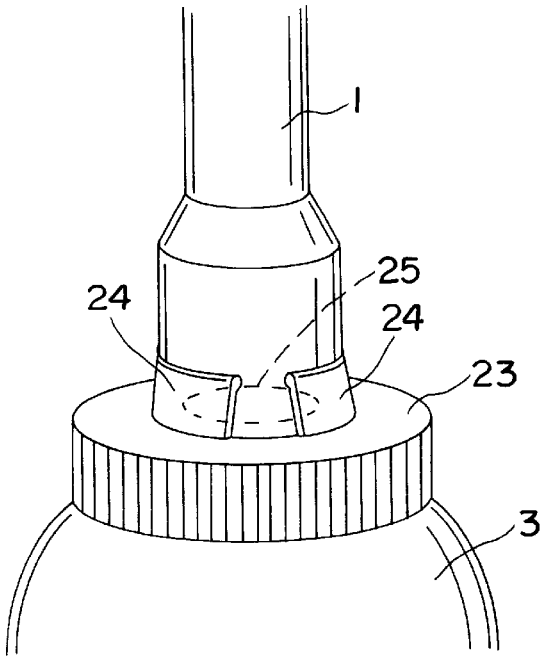
FIGS. 6*a, b* is another embodiment in which the container lid has integral features which releasably couple to the light source.
Figure 6B:
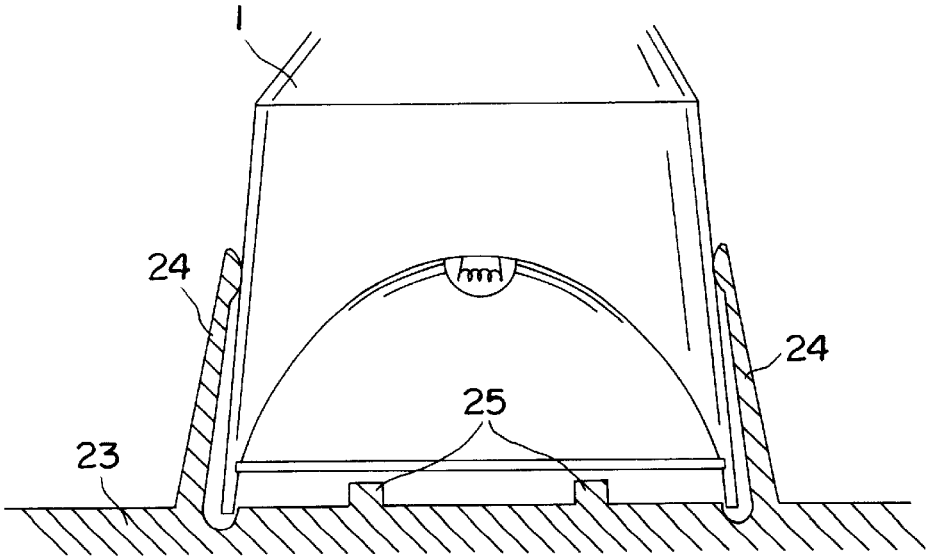

FIG. 6 shows an embodiment of the invention where the container lid 23 has integrated features 24, 25 which releasably attach to a flashlight. The features in this embodiment are disposed co-axially with the flashlight barrel. The outer feature 24 is shown anchoring a flashlight by way of a friction fit caused by the flashlight pushing against the integrated features. The inner feature 25 attaches by means of a friction fit to smaller diameter flashlight not shown.

Figure 9:
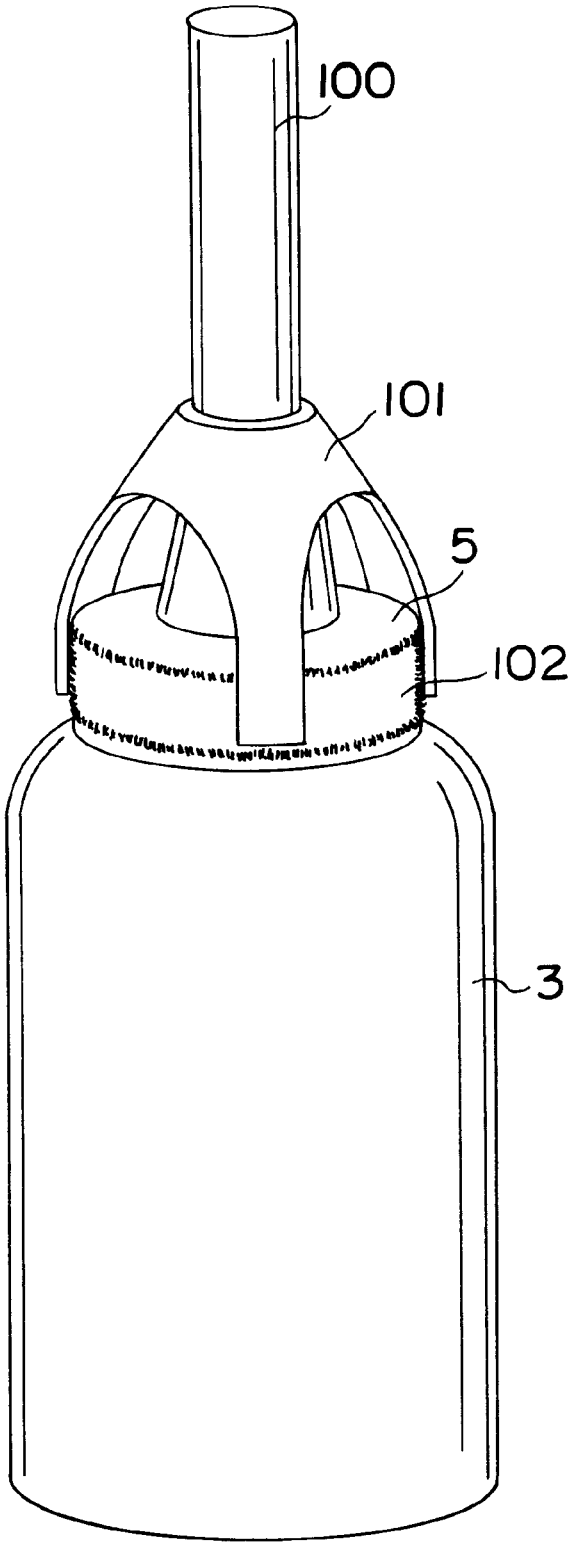
FIG. 9 is an alternative embodiment wherein a container lid is modified with hook or loop material to provide attachment means.

FIG. 9 shows an embodiment of the invention where the lid 5 has been modified so that the hook or loop material 102 is disposed around the outer circumferential wall of the lid, either permanently or releasably. A three legged coupler 101 is shown in this embodiment although any of the couplers described above could be modified for use in this embodiment.

Figure 10A:
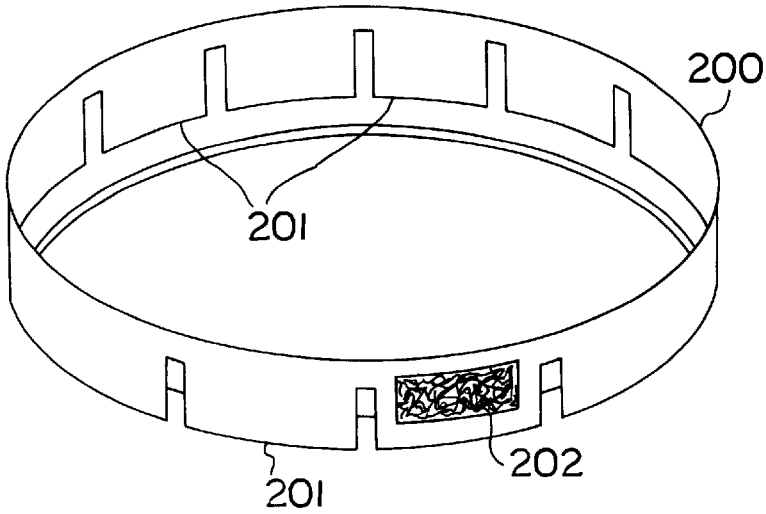
FIGS. 10*a, b* are alternative embodiments of the aspect of the invention in FIG. 9.
Figure 10B:
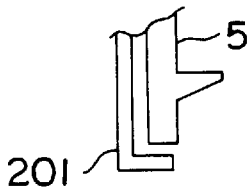

FIG. 10*a* is an embodiment where the connecting material (hook and loop) 202 is releasably disposed around the lid circumference. The molded part 200 consists of a cylindrically shaped part having a diameter slightly larger than the lid and containing molded-in locking features 201. The device is slid down around the lid 5 causing the locking features to deploy thereby resisting an upward force. The device has attached to it the material 202 which is the second releasable connector for lightsource attachment. FIG. 10*b* is a detail cross section of the device 200 during use. The locking feature 201 is shown deployed around the bottom of the lid 5 in order to resist the upward force so that connection to the coupler is made possible.

Figure 14A:
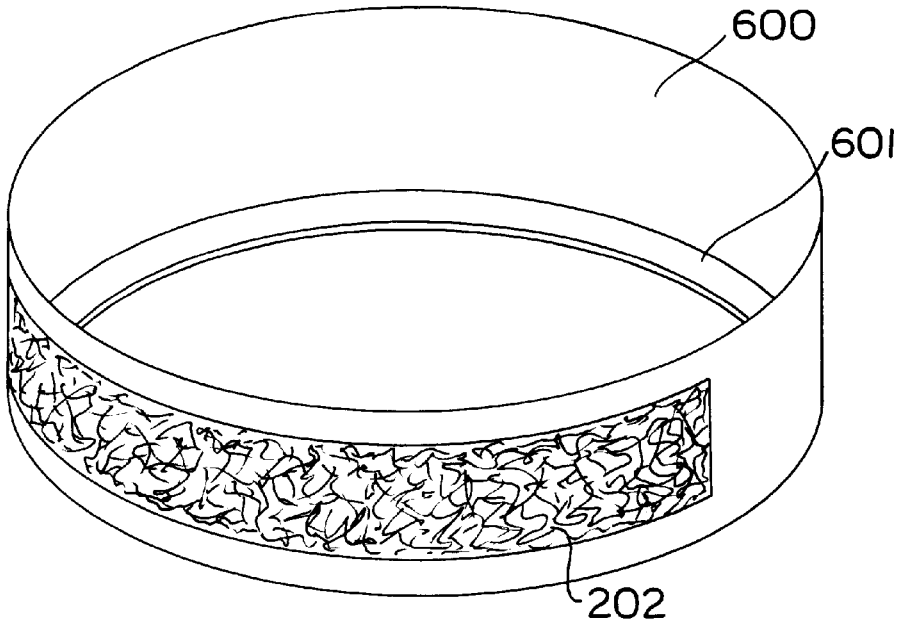
FIGS. 14*a, b* are alternative embodiments of the aspect of the invention in FIG. 9.
Figure 14B:
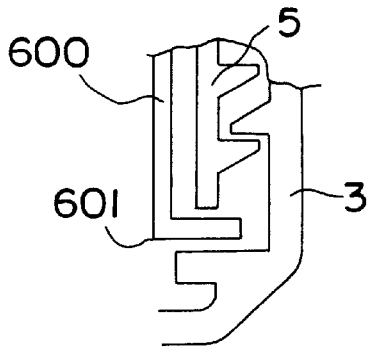

FIG. 14*a* is an alternate embodiment where the connecting material (hook and loop) 202 is releasably disposed around the lid circumference. The molded part 600 consists of a cylindrically shaped part having a diameter slightly larger than the lid and having an inwardly projecting lip 601 that has an inner diameter smaller than the lid outer diameter but larger than any projecting features of the neck part of the container. The device 600 is slid down a lidless container to rest on the shoulder of the container below the neck or onto some projecting feature of the neck part of the container (not shown). The device has attached to it the material 202 which is the second releasable connector for lightsource attachment. FIG. 14*b* is a detail cross section of the device 600 during use. The projecting lip 601 is shown stopped against further upward movement by the bottom of lid 5 in order to resist the upward force so that connection to the coupler is made possible.

Figure 11:
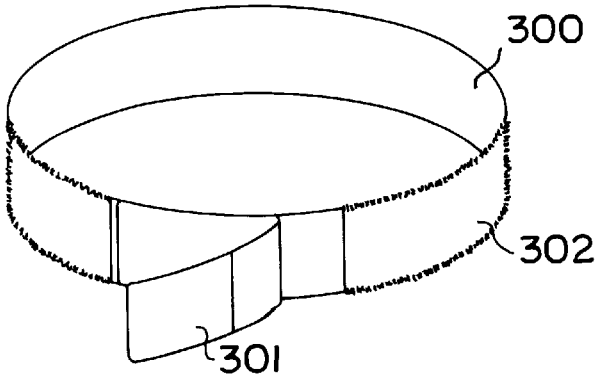
FIG. 11 is an alternative embodiment of the aspect of the invention in FIG. 9.

FIG. 11 shows yet another embodiment in which a separate band 300 is releasably attached to the container lid in order to provide a non-permanent releasable attachment means for the couplers described above. Band 300 is slid down around the lid and then clamped by using a hand enabled conventional over-center clamping mechanism 301. Attachment material 302 is thus deployed around the outer wall of the device to provide the second releasable connector for lightsource attachment.

Figure 7A:
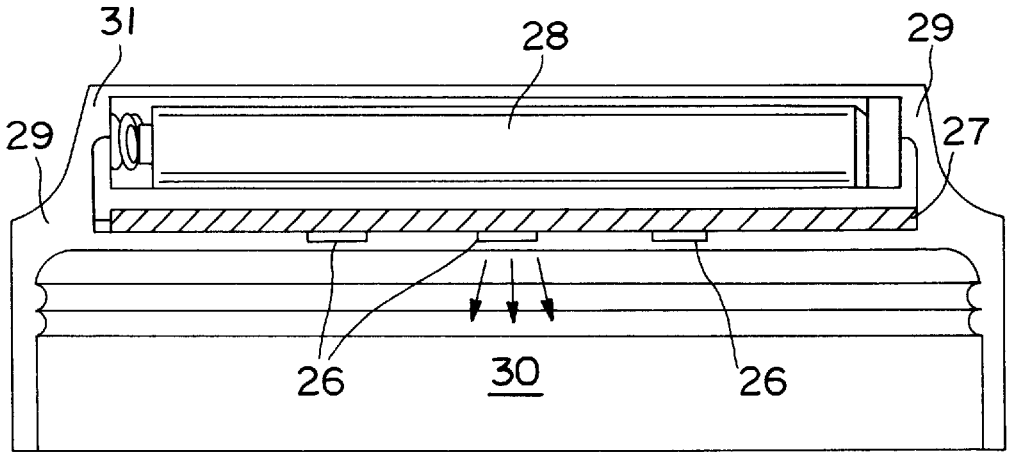
FIGS. 7*a, b* is another embodiment where light emitting diodes, a driving circuit and power supply are directly integrated into a container lid.
Figure 7B:
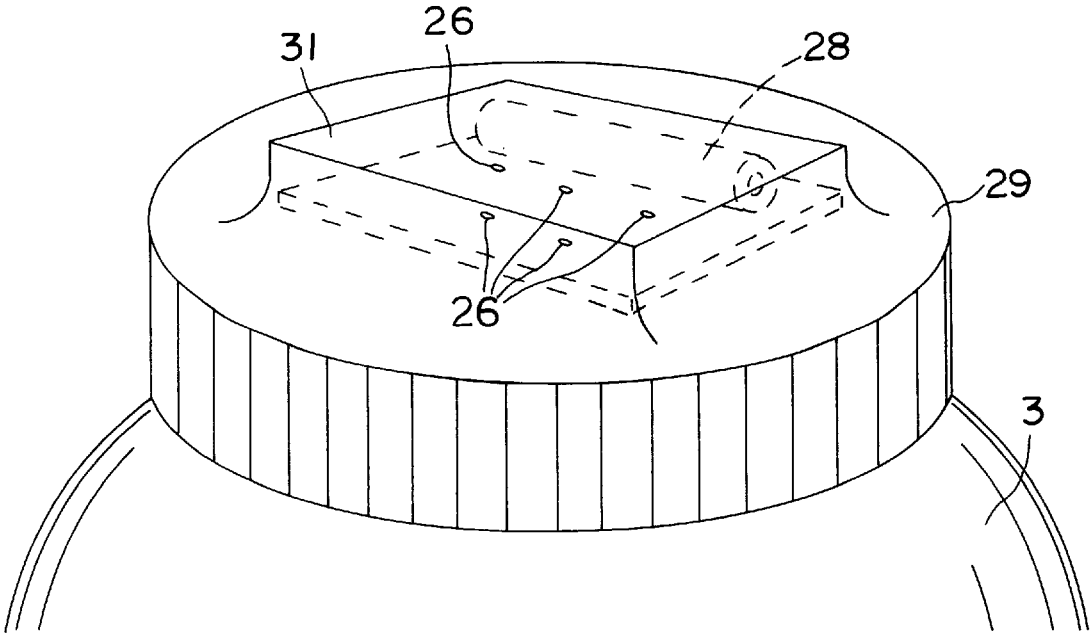

FIG. 7 shows an embodiment where light emitting diode (LED) devices 26, a driving circuit 27, and a power supply 28, in this case two batteries, are integrated permanently into a container lid 29. The LED devices 26, are mounted on a printed circuit board 27. The printed circuit board (PCB) contains an LED driving circuit, which are well known in the art, and is powered by one or more batteries 28. The PCB may be embedded in the lid by way of co-molding, or it may be attached after lid fabrication. The LED's are mounted on the side of the PCB facing the interior of the container so that their light is directed into the interior of the container 30 when the lid is in place. A battery case feature 31 may also be either molded into the lid or attached to a fabricated lid.

Figure 8A:
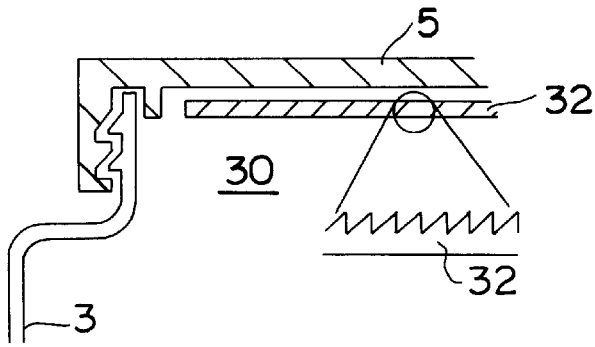
FIG. 8 is the embodiment which utilizes light redirecting film or light redirecting features.
Figure 8B:
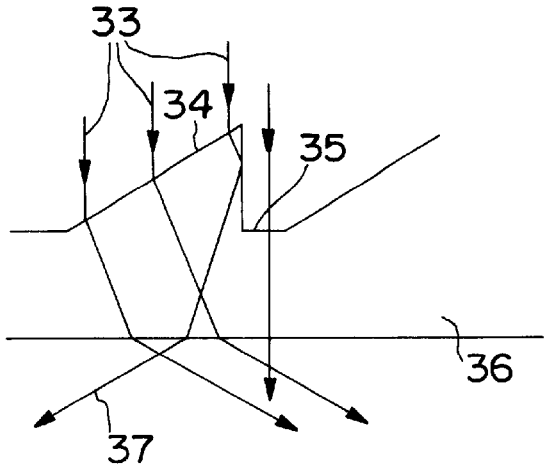
Figure 8C:
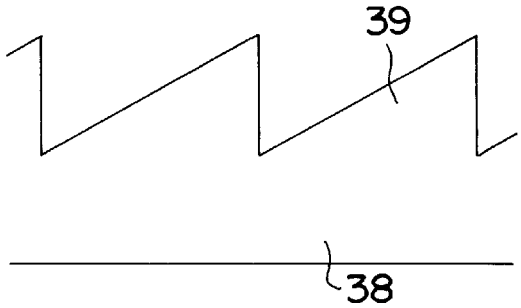

FIG. 8*a* shows the position of the light redirecting film 32 in the invention. It is preferably positioned between the container lid 5 and the interior of the container 30, but may be disposed above the lid as well. The light redirecting film is comprised of an optically transparent or non-opaque material which has a variable thickness thereby redirecting the light coming from the light source. FIG. 8*b* shows one possible embodiment of the film. This design is a variation on designs known in the art and which are commercially available from companies including 3M. Most of this class of films have features which vary in one dimension and are unvarying in the second dimension, the third dimension containing their thickness. In FIG. 8*b* the light rays 33, which originate from the light source of the lantern, are shown impinging on the film surfaces 34 and 35. The film material 36, having a density greater than air, refracts the light as shown. In the design shown, most of the light will be redirected to the right of the figure because more light will strike surface 34 than will strike surface 35. Differing designs, having different relative surface areas of surfaces 34 and 35 would redirect more or less light to the right of the figure. Also, some rays 37 of the design will be directed to the left of the figure due to their internal reflection in the film 36. FIG. 8*c* shows another embodiment of the film 38 where the prism feature 39 takes up all of the film surface. Any conceivable film design could be inserted into, or be integrally cast or molded into the container lid of, in any of the embodiments of the invention discussed above. In addition, other reflection means (not shown) may be employed. For example part 21 in FIG. 5 may have an inner reflective surface. Also reflective films (not shown) may be disposed on the container walls, either inside or outside, wholly or partially covering some or all of the container surfaces, leaving only some of the container surfaces to emit light. Such reflective films may comprise white or silvered reflecting materials such as a white ink screening or a reflective laminant.

I claim:

1. A lantern comprising: a closeable translucent container, a light source external to the container and a coupler for releasably connecting the container to the light source wherein the coupler further comprises:

a) an elastomeric coupler having a central portion and an outer portion, the center portion having a hole, and the outer portion further comprising at least one first releasable connector;

b) a second releasable connector attachable to the container for releasable connection to the first connector.

2. The lantern of claim 1 wherein the second connector further comprises a plurality of attachment rings on the perimeter of the connector.

3. The lantern of claim 1 wherein the second connector further comprises a dish-shaped part engageable with a bottom of the container.

4. The lantern of claim 1 wherein the first connector has a hole in its center, and wherein the outer portion of the first connector comprises a plurality of legs.

5. A lantern comprising: a closeable translucent container, a light source external to the container and a coupler for releasably connecting the container to the light source wherein the coupler further comprises: a) at least one first releasable connector; b) a second releasable connector attachable to the container for releasable connection to the first connector, and the lantern further comprising a container lid closed upon the container, wherein the second connector is attached to the lid and wherein the lid is translucent.

6. The lantern of claim 4 further comprising:

a reflector on a bottom of the container, and a reflector which at least partially covers a wall of the container.

7. The lantern of claim 4 further comprising a light redirecting film interposed between the light source and the container interior.

8. The lantern of claim 7 wherein the light redirecting film has a thickness greater than zero and less than 5 millimeters.

9. The lantern of claim 7 wherein the light redirecting film is made of a transparent material having a variable thickness.

10. The lantern of claim 7 wherein the container lid comprises the light redirecting film.

11. A lantern kit comprising a coupler adapted to releasably connect a translucent container to a light source that is external to the container wherein the coupler further comprises a band of resilient material having attached on at least a portion of its outer circumference some hook and loop material, the band lockable onto the lid.

12. A lantern comprising a coupler adapted to releasably connect a translucent container to a light source that is external to the container wherein the coupler further comprises:

a) an elastomeric coupler having a central portion and an outer portion, the center portion having a hole, and the outer portion further comprising at least one first releasable connector;

b) a second releasable connector attachable to the container for releasable connection to the first connector.

* * * * *